US006893147B2

(12) United States Patent
Schottland et al.

(10) Patent No.: US 6,893,147 B2
(45) Date of Patent: May 17, 2005

(54) LAMP LENS OR BEZEL WITH VISUAL EFFECT

(75) Inventors: Philippe Schottland, Evansville, IN (US); David S. Bryce, Novi, MI (US); Thomas Bouchard, Rochester Hills, MI (US)

(73) Assignee: General Electric Company, Schenectady, NY (US)

( * ) Notice: Subject to any disclaimer, the term of this patent is extended or adjusted under 35 U.S.C. 154(b) by 64 days.

(21) Appl. No.: 10/063,791

(22) Filed: May 13, 2002

(65) Prior Publication Data

US 2003/0189838 A1 Oct. 9, 2003

Related U.S. Application Data

(60) Provisional application No. 60/370,790, filed on Apr. 5, 2002.

(51) Int. Cl.[7] ..... F21V 9/16
(52) U.S. Cl. ..... 362/510; 362/84; 362/293
(58) Field of Search ..... 362/509, 510, 362/260, 84, 307, 311, 335, 293; 428/31; 524/93, 107

(56) References Cited

U.S. PATENT DOCUMENTS

| | | | | |
|---|---|---|---|---|
| 2,798,147 | A | 6/1957 | Orsatti | |
| 3,972,849 | A | 8/1976 | Bruenemann et al. | |
| 4,005,111 | A | 1/1977 | Mach et al. | |
| 4,217,438 | A | 8/1980 | Brunelle et al. | |
| 4,379,934 | A | 4/1983 | Graser et al. | |
| 4,446,324 | A | 5/1984 | Graser | |
| 4,486,587 | A | 12/1984 | Seybold | |
| 4,618,694 | A | 10/1986 | Iden et al. | |
| 4,667,036 | A | 5/1987 | Iden et al. | |
| 4,716,501 | A * | 12/1987 | McKee et al. | 362/31 |
| 5,136,483 | A * | 8/1992 | Schoniger et al. | 362/545 |
| 5,470,502 | A | 11/1995 | Hahn et al. | |
| 5,605,761 | A * | 2/1997 | Burns et al. | 428/412 |
| 5,672,643 | A | 9/1997 | Burns et al. | |
| 5,674,622 | A | 10/1997 | Burns et al. | |
| 5,710,197 | A | 1/1998 | Fischer et al. | |
| 5,754,337 | A | 5/1998 | Burns et al. | |
| 5,920,429 | A | 7/1999 | Burns et al. | |
| 6,219,329 | B1 | 4/2001 | Tanaka et al. | |
| 6,502,974 | B2 * | 1/2003 | Chase et al. | 362/549 |
| 2001/0040811 | A1 | 11/2001 | Chase et al. | |

FOREIGN PATENT DOCUMENTS

| | | |
|---|---|---|
| EP | 0 073 007 | 3/1983 |
| EP | 0409483 A2 | 1/1991 |
| EP | 0 422 474 | 4/1991 |
| EP | 0 692 517 | 1/1996 |
| FR | 2634539 A1 | 1/1990 |
| FR | 2673018 A1 | 8/1992 |
| JP | 11073804 A | 3/1999 |
| JP | 2001-106888 | 4/2001 |
| WO | WO 96/17012 A1 | 6/1996 |
| WO | WO 01/26984 A1 | 4/2001 |
| WO | WO 01/62867 | 8/2001 |
| WO | WO 01/94496 A1 | 12/2001 |

* cited by examiner

*Primary Examiner*—Sandra O'Shea
*Assistant Examiner*—Guiyoung Lee
(74) *Attorney, Agent, or Firm*—Oppedahl & Larson LLP

(57) ABSTRACT

Lenses and bezels for lamps provide an appealing aesthetic look in the form of a colored glow at the edges of the lens or bezel by incorportation of an photoluminescent material in a molded polycarbonate body. The lenses are particularly suitable for use as an automotive outer lens, and can also improve the quality of the light emitted through this outer lens by interacting with the light bulb. The emitted beam is of a legal color and intensity as defined per the SAE J578 standard. The lighting performance may also be improved in such manner as reducing glare, increasing brightness or producing a beam that enhances road visibility at night to the human eye.

100 Claims, 2 Drawing Sheets

LAMP LENS OR BEZEL WITH VISUAL EFFECT

CROSS REFERENCE TO RELATED APPLICATIONS

This application claims the benefit of U.S. Provisional Application Ser. No. 60/370,790 filed Apr. 5, 2002, which application is incorporated herein by reference.

BACKGROUND OF INVENTION

This application relates to lenses or bezels which may be used in lamps, particularly automotive headlamps, which provide a visual effect in the form of an aesthetic colored glow at the edges of the lens or bezel.

Automotive headlamps are highly controlled products that must meet the SAE performance standard (SAE J1383) to be commercialized. To be compliant, the combination bulb (i.e. the light source)/lens must emit a "white" color and provide enough light output (usually characterized by the total luminous flux "isocandela" and "maximum candela" point intensity testing) in a homogeneous manner. Specifications have been defined around the white beam color as presented in the SAE J578 standard. The white beam color is defined as a small portion of the color space in the CIE 1931 chromaticity diagram. The allowed portion of the color space if defined by blue, yellow, green, purple, and red boundaries that stem from the CIE 1931 x and y color coordinates. Commercially available headlamps use different types of bulbs but usually a "natural" colored lens or slightly tinted lens. In general, these lenses have a clear appearance but could display a very subtle blue or yellow tint. The most common bulb on the market is a halogen bulb. In the past few years, high performance bulbs have been introduced. These new bulbs usually referred to as HID ("High Intensity Discharge") are in fact Xenon lamps. It is well known to those of average skill in the art that the power spectral distribution of a Xenon bulb is different from a halogen bulb. For example, a Xenon bulb will emit more energy at lower wavelengths and especially in the 300 to 500 nm range that corresponds to the long UV up to violet/blue-green. As a result, the light emitted from the HID is bluer compared to a halogen bulb which will consequently appear more yellow. When mounted in a headlamp, the beam emitted from a HID/"natural" lens combination will appear whiter compared to whereas the halogen bluer. A whiter beam is commonly acknowledged as more efficient since it enhances the road visibility at night. However, there are two major disadvantages to the use of HID bulbs in headlamps. Firstly, these high performance bulbs are extremely expensive compared to halogen bulbs. As a result, headlamps based on HID bulbs are a limited market, often offered as an option on vehicles for an extra-cost in the $1,200 range. Secondly, these headlamps have a tendency to blind the drivers on the other side of the road thus potentially increasing the risk of car accident.

Automotive headlamp lenses are usually made of natural color or slightly tinted polycarbonate as a main material. The primary reasons behind the use of polycarbonate are its relatively high glass transition temperature and excellent clarity/light transmission in the visible range. Lexan® LS-2 polycarbonate is one of the leading materials currently in use for automotive lenses; including headlamp lenses, bezels and taillight lenses. Other high glass transition temperature materials are also being used including copolymers but their natural color or light transmission sometimes renders the emitted headlamp beam of a lesser quality. It is well known to those skilled in the art of coloring automotive lenses that the natural or slightly tinted polycarbonate lenses are obtained by addition of a small amount of organic colorants (i.e. dyes or pigments). For example, a blue dye is added to a yellow formulation to neutralize the color (i.e. make the polycarbonate more colorless or "natural"). The main downside of coloring is the decrease in light transmission that results from the absorption of the colorants even when they are present in the polymer matrix at a ppm loading or below. Consequently, the great majority of the lenses that are mounted in headlamps are "natural" or barely tinted.

SUMMARY OF INVENTION

The present invention provides lenses and bezels for lamps that provide an appealing aesthetic look in the form of a colored glow at the edges of the lens or bezel by incorportation of a photoluminescent material in a molded polycarbonate body. The lenses are particularly suitable for use as an automotive outer lens, and can also improve the quality of the light emitted through this outer lens by interacting with the light bulb. The emitted beam is of a legal color and intensity as defined per the SAE J578 standard. The lighting performance may also be improved in such manner as reducing glare, increasing brightness or producing a beam that enhances road visibility at night to the human eye. The invention further provides assembled automobile headlamps which incorporate the outer lenses and/or bezels of the invention.

DETAILED DESCRIPTION

Figure 1:
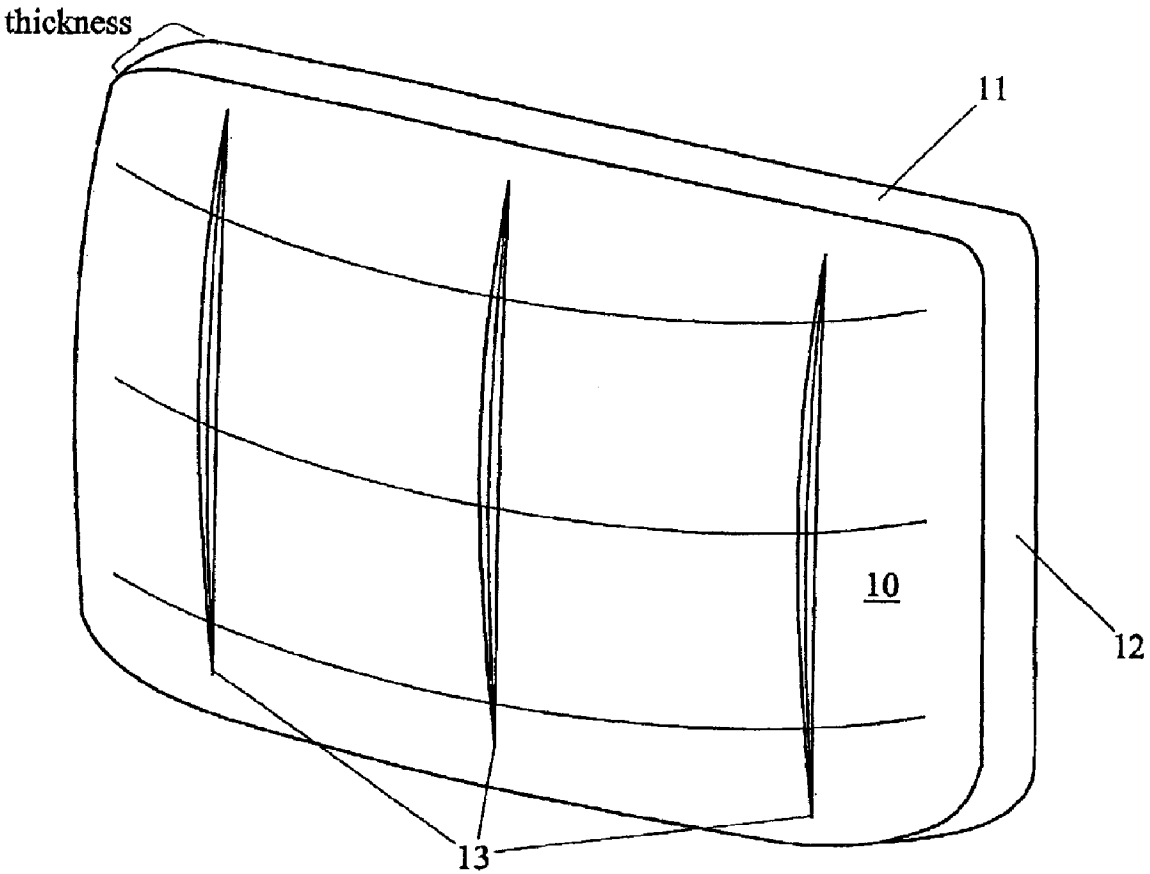
FIG. 1 shows a lamp lens in accordance with the invention.

This application relates to lenses and bezels which can be used in combination with lamps to provide an aesthetic visual effect in the form of a colored glow at the edge of the lens or bezel when the lamp is turned on. In preferred applications, the lens is constructed and sized to serve as the outer lens of an automotive headlamp with or without a bezel. Headlamps may also be made which include a bezel providing a visual effect with a conventional lens. Alternatively, the lens or bezel may be designed to fit on a flashlight or other lamp.

The lens of the present invention comprises a molded body having a generally concave outer surface, a flat or convex inner surface and an edge surface, wherein the molded body is formed from a composition comprising polycarbonate and a photoluminescent material. Light which includes light of a wavelength within the excitation spectrum of the photoluminescent material is partially absorbed and partially transmitted. The absorbed light is at least partially (depending on the quantum yield of the luminescence) emitted as light of a higher wavelength (as a result of a Stokes shift) and is conducted to a substantial extent to the edge surface of the lens thereby creating a colored visual effect at the edge of the lens. As used in the specification and claims of this application, the term "substantial extent" means in an amount effective to create an observable visual effect. Generally at least 10% of the light emitted by photoluminensence is conducted through the interior of the lens to the edges, preferably at least 30%. This is achieved in polycarbonate lenses and bezels because the high index of refraction results in significant amount of internal reflection."

In the context of a lens for an automotive headlamp, various standards must be met. The lenses of the present invention light from an automotive headlamp which is of a legal color and intensity as defined per the SAE J578 standard. The lighting performance may also be improved in such manner as reducing glare, increasing brightness or producing a beam that enhances road visibility at night to the human eye. Headlamps manufactured using this invention can produce for instance a lower cost alternative to the expensive High Intensity Discharge (HID) lamps in terms of lighting performance while providing more comfort for the driver but also for the cars on the other side of the road because the blinding effect of HID lamps is not observed. In addition to the lighting performance, the headlamps also display a different aesthetic look by creating accent features in the outer lens thus allowing for product differentiation. These features are obtained by creating a synergy between the outer lens and the bulb. The lenses of the present invention are formed from a polycarbonate and one or more photoluminescent materials. As used in the specification and claims of this application, the term "photoluminescent material" refers to any substance that exhibits photoluminescence in response to excitation energy provided by ambient light (sunlight, room light and other artificial light sources), including without limitation organic compounds that solubilize in the plastic polymer matrix during the compounding operation, organic nanoparticle dyes (also known as "nano-colorants") and inorganic photoluminescent materials, including nanoparticles. Photoluminescence occurs when a substance absorbs radiation of a certain wavelength and re-emits photons, generally of a different and longer wavelength. When a photoluminescent molecule absorbs light, electrons are excited to a higher "excited" energy state. The molecule then loses part of its excess of energy by collisions and internal energy conversions and falls to the lowest vibrational level of the excited state. From this level, the molecule can return to any of the vibrational levels of the ground state, emitting its energy in the form of photoluminescence. Photoluminescence is a generic term which encompasses both fluorescence and phosphorescence. In the present invention, the photoluminescent materials are preferably organic fluorescent dyes because of the higher quantum yield associated with fluorescence as opposed to other types of photoluminescent processes. Preferably, the organic fluorescent dye is selected to have a quantum yield of fluorescence of at least 0.7, more preferably at least 0.8 and most preferably at least 0.9 Typically, the emission by fluorescence is an extremely brief phenomenon lasting generally between $10^{-4}$ and $10^{-9}$ seconds.

Specific non-limiting examples of fluorescent dyes that may be used in the articles of the invention are perylene derivatives, anthracene derivatives, indigoid and thioindigoid derivatives, imidazole derivatives, naphtalimide derivatives, xanthenes, thioxanthenes, coumarins, rhodamines, or (2,5-bis[5-tert-butyl-2-benzoxazolyl] thiophene) and all their derivatives. In general, very low loadings of dyes, for example less than 1.0% are used to create the effect described in this invention. In certain cases, it may be desired to have a final object with the effect of this invention but with almost no visible color (for example a "clear" water bottle). In these cases, the fluorescent dye loading can be extremely low, sometimes as low as 0.0001%. Except for the blue/violet colors and maybe some greens, the fluorescent dye loading to retain the "clear" appearance is usually lower than 0.0005% by weight, for example from 0.0001% to 0.0003% by weight, which is enough to generate a very noticeable visual effect at the edges of the article. In the blue/violet colors, the fluorescent dye loading is significantly higher due to the fact that most of its absorption is located in the UV range. Typically, the fluorescent dye loading in this case is between 0.005% to 0.5% by weight, with 0.01% to 0.2% being preferred and 0.03% to 0.1% being most preferred. Nano-colorants can be obtained by various methods and usually combine the advantages of both dyes and pigments. Their light fastness compared to the corresponding dye molecule is usually greatly improved. Since their particle size is in general less than 100 nanometers, preferably less than 50 nm, and more preferably less than 10 nm, they do not scatter light conversely to most pigments used to color plastics.

Nano-colorants can be obtained by various methods. For example, dye molecules can be converted to nano-colorants by adsorption on a nano-clay particle (with or without creating a chemical bond between the nano-clay and the dye) or by nano-encapsulation in a polymer matrix (usually acrylic polymer). Note that the encapsulation method usually involves emulsion polymerization in order to form spherical nano-particles of polymer in which the dye is dispersed. Nano-colorants can be fluorescent if the dye molecule (or the inorganic compound) used to prepare the nano-colorant is fluorescent. Specific non-limiting examples of fluorescent dyes that may be employed to form nano-colorants used in the articles of the invention are perylene derivatives, anthracene derivatives, indigoid and thioindigoid derivatives, imidazole derivatives, naphtalimide derivatives, xanthenes, thioxanthenes, coumarins, rhodamines, or (2,5-bis[5-tert-butyl-2-benzoxazolyl]-thiophene) and all their derivatives.

Inorganic nano-particles may also be used as nano-colorants although their extinction coefficient is usually fairly low. Examples of fluorescent inorganic nano-particles include, but are not limited to, lanthanide complexes and chelates (for instance Europium chelates). Note that some of these inorganic nano-colorant may exhibit a larger Stokes shift than organic fluorescent colorant, i.e. emit light at a much longer wavelength than the excitation wavelength.

The fluorescent dye(s) used in the formulation of the lenses of the invention can be combined with non-fluorescent dyes in order to change the chromaticity of the edge color under daylight illumination or when the bulb is on (night time). Non-fluorescent dyes may be selected from but are not limited to the following families: azo dyes, methine dyes, pyrazolones, quinophtalones, perinones, anthraquinones, phtalocyanines and all their derivatives. The selection of the dye should maximize the synergy between the bulb used and the lens. In other words, the light emitted by the bulb (e.g. a halogen bulb) must be transformed by the lens in such a way that the desired color of visual effect is obtained with the maximum strength while the beam color complies with the SAE requirements (white color beam). By creating a synergy between the bulb and the fluorescent dyes in the lens, the beam intensity expressed by the maximum candela and the total luminous flux in the headlamp can be controlled within +/−5% of the headlamp made with a "natural" color lens. In addition, it is also possible to customize the beam color within the allowed design space defined by the SAE in the CIE 1931 chromaticity diagram. For instance, a blue lens/halogen bulb combination can exhibit a cleaner (or "whiter") beam compared to a "natural" lens. The human eye perceives this difference as a better lighting performance. It must be noted that this "whiter" illumination is a key feature of Xenon bulbs (i.e. HID lamps) but these lamps are known for their extreme blinding effect to the drivers coming on the other side of the road. The blue lens/halogen bulb combination not only exhibits a very noticeable blue visual effect but also provides a beam of a "whiter" color that constitutes a lighting performance improvement compared to "natural" color lens/halogen bulb combination. Note that the whiter beam generated with the halogen bulb does not create the same blinding effect that is observed with HID lamps. The final outer lens/bulb combination is designed to provide a beam color inside the following boundaries defined by the CIE 1931 chromaticity coordinates and preferably measured using spectrophotometric methods as presented in the ASTM standard E308-66:

$x$=0.31 (blue boundary)

$x$=0.50 (yellow boundary)

$y$=0.15 +0.64×(green boundary)

$y$=0.05 +0.75×(purple boundary)

$y$=0.44 (green boundary)

$y$=0.38 (red boundary)

The dyes used in the lens composition suitably have a heat stability over 300° C., with 320° C. preferred and 350° C. even more preferred for automotive applications. Lower or higher temperatures may be required in other applications depending on the heating characteristics of the lamp employed with the lens. It is important to use organic dyes rather than pigments and especially rather than inorganic pigments. The reason is that pigments have a tendency to scatter light and thus increase haze in the molded lens. Pigments that either fully solubilize in the polycarbonate composition or disperse in particles that do not significantly scatter light may be acceptable at a very low loading.

The polycarbonate component of the lenses of the invention includes compositions having structural units of the formula (I) and a degree of polymerization of at least 4:

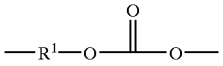

(I)

in which R1 is an aromatic organic radical. Polycarbonates can be produced, for instance, by the interfacial reaction of dihydroxy compounds. Preferably, $R^1$ is an aromatic organic radical and, more preferably, a radical of the formula (II):

$$—A^1—Y^1—A^2— \quad (II)$$

wherein each of $A^1$ and $A^2$ is a monocyclic divalent aryl radical and $Y^1$ is a bridging radical having zero, one, or two atoms which separate $A^1$ from $A^2$. In an exemplary embodiment, one atom separates $A^1$ from $A^2$. Ilustrative, non-limiting examples of radicals of this type are —O—, —S—, —S(O)—, —S($O_2$)—, —C(O)—, methylene, cyclohexyl-methylene, 2ethylidene, isopropylidene, neopentylidene, cyclohexylidene, cyclopentadecylidene, cyclododecylidene, adamantylidene, and the like. In another embodiment, zero atoms separate $A^1$ from $A^2$, with an illustrative example being biphenol (OH-benzene-benzene-OH). The bridging radical $Y^1$ can be a hydrocarbon group or a saturated hydrocarbon group such as methylene, cyclohexylidene or isopropylidene.

Polycarbonates can be produced by the reaction of dihydroxy compounds in which only one atom separates $A^1$ and $A^2$. As used herein, the term "dihydroxy compound" includes, for example, bisphenol compounds having general formula (III) as follows:

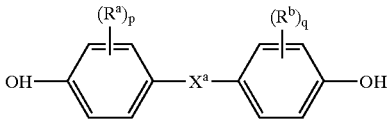

(III)

wherein $R^a$ and $R^b$ beach independently represent hydrogen, a halogen atom, or a monovalent hydrocarbon group; p and q are each independently integers from 0 to 4; and $X^a$ represents one of the groups of formula (IV):

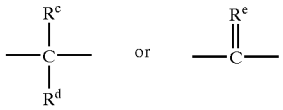

(IV)

wherein $R^c$ and $R^d$ each independently represent a hydrogen atom or a monovalent linear or cyclic hydrocarbon group, and $R^e$ is a divalent hydrocarbon group.

Some illustrative, non-limiting examples of suitable dihydroxy compounds include dihydric phenols and the dihydroxy-substituted aromatic hydrocarbons such as those disclosed by name or formula (generic or specific) in U.S. Pat. No. 4,217,438. A nonexclusive list of specific examples of the types of bisphenol compounds that may be represented by formula (III) includes the following: 1,1-bis(4-hydroxyphenyl) methane; 1,1-bis(4-hydroxyphenyl) ethane; 2,2-bis(4-hydroxyphenyl) propane (hereinafter "bisphenol A" or "BPA"); 2,2-bis(4-hydroxyphenyl) butane; 2,2-bis(4-hydroxyphenyl) octane; 1,1-bis(4-hydroxyphenyl) propane; 1,1-bis(4-hydroxyphenyl) n-butane; bis(4-hydroxyphenyl) phenylmethane; 2,2-bis(4-hydroxy-1-methylphenyl) propane; 1,1-bis(4-hydroxy-t-butylphenyl) propane; bis (hydroxyaryl) alkanes such as 2,2-bis(4-hydroxy-3-bromophenyl) propane; 1,1-bis(4-hydroxyphenyl) cyclopentane; 4,4"-biphenol ;and bis(hydroxyaryl) cycloalkanes such as 1,1-bis(4-hydroxyphenyl) cyclohexane; and the like as well as combinations comprising at least one of the foregoing bisphenol compound.

It is also possible to employ polycarbonates resulting from the polymerization of two or more different dihydric phenols or a copolymer of a dihydric phenol with a glycol or with a hydroxy- or acid-terminated polyester or with a dibasic acid or with a hydroxy acid or with an aliphatic diacid in the event a carbonate copolymer rather than a homopolymer is desired for use. Generally, useful aliphatic diacids have about 2 to about 40 carbons. A preferred aliphatic diacid is dodecandioic acid.

The polycarbonate component may also include various additives ordinarily incorporated in resin compositions of this type. Such additives are, for example, fillers or reinforcing agents; heat stabilizers; antioxidants; light stabilizers; plasticizers; antistatic agents; mold releasing agents; additional resins; and blowing agents. Combinations of any of the foregoing additives may be used. Such additives may be mixed at a suitable time during the mixing of the components for forming the composition.

The outer lens is usually produced by injection molding of a polycarbonate resin composition in a compounded form. The polycarbonate formulation is usually compounded in an extruder in order to provide appropriate mixing of the composition. Although the use of a single-screw extruder is conceivable, a twin-screw extruder is usually preferred to optimize the mixing and reduce the likelihood of creating scattering particles in the final product or simply avoid potential streaking issues that may stem from undissolved high-melting point colorants such as some perylene derivatives (melting point around 300° C.). Although the polycarbonate composition is generally light stabilized and the lens coated with a UV absorptive coating, it is important to use dyes that combine improved light fastness and heat stability. Good examples of fluorescent dyes with an improved light fastness and high heat stability are the perylene derivatives like the Lumogen Orange F-240, Lumogen Red F-300 and Lumogen Yellow F-083 supplied by BASF.

In order to better control the extremely low amount of dyes introduced in the formulation and therefore have a better color control of the lens, the use of volumetric or gravimetric feeders is highly recommended. The feeders can either feed a letdown of the concentrate in polycarbonate resin powder (preferably milled powder) or feed an already compounded (extruded) color masterbatch in a pellet form. The colorant loading in the letdown or the concentration of the masterbatches depends on the feeder capability, and especially the feeding rate. In general, powder letdown vary between 10:1 and 10,000:1 ratios of colorant (i.e. dye) to powder. Dye mixtures can also be used in a letdown form and fed from a single feeder although it is not the most preferred method. Poor color control may potentially result in lenses that would not be suitable for a headlamp application, i.e. beam color or light output not being compliant with the SAE standard.

Using this invention, one can produce lenses that specifically interact with HID lamps and create colorful visual effect while reducing the blinding effect. This can be obtained, for example, by using a lens containing a fluorescent dye in such manner that a part of the blue light responsible for the blinding effect is shifted to higher wavelengths where the human eye has a lower spectral sensitivity. For example, the spectral characteristics of a yellow fluorescent dye like the BASF Lumogen Yellow F-083 or a red fluorescent dye like the Lumogen Red F-300 are such that they will shift the beam color towards the yellow or red respectively thus making the beam appear less "blue" and therefore less blinding. Other combinations of visual effect lenses with less common bulbs than halogen may provide customized aesthetic effect on vehicles but also customized lighting performance. An example would be to use a lens containing fluorescent dyes that absorb wavelengths outside the visible range (e.g. below 380 nm) and reemit in the visible, in combination with a UV rich light source (as for example a HID bulb). This would translate into an increase of the visible intensity of the beam compared to the emission from the natural lens and potentially allow for a reduction of the necessary voltage thus saving some battery power.

FIG. 1 shows an embodiment of a lens in accordance with the invention. The lens has an outer surface 10, which has a generally convex curvature, and an opposing rear surface 11 which may be flat or concave. The overall thickness of the lens at its edge 12 is in the range of from 0.5 to 10 mm, for example 3.0 mm. The center portion of the lens may be thicker or thinner than the edge thickness, provided that structural integrity is maintained (the necessary thickness will depend to some extent on the other dimensions of the lens), and can be variable as the result of formation of rib lines 13 which are cut into the surface. Ribs or "design features" in the lens can be protrusions or depressions. V-shapes are usually preferred for depressions. Protrusions have preferably squared tops but round tops are also possible. The overall shape of the lens may be a rounded rectangle as shown, or it may be round or ovoid or any other appropriate shape for use with a particular lamp. For example, for some automotive headlamp applications, the lens may extend around the front corner of the vehicle, spanning parts of both the front and side surfaces of the vehicle.

The present invention can also be translated to other applications than headlamps lenses, such as bezels, or lighting equipment where a synergistic combination of light source and a visual effect outer lens will offer new aesthetic solutions with comparable or improved lighting performance. Thus, the invention also provides a bezel formed from a polycarbonate resin containing an photoluminescent material. The bezel has essentially the same outer shape at the lens with which it will be used, but has a central opening. Thus, a bezel according to the invention is a substantially annular structure having a generally concave outer surface and a generally convex or flat inner surface. The surface may have ribs or grooves to facilitate assembly with the lens and housing, or for decorative purposes. The overall thickness of the bezel at its outer edge is in the range of from 0.5 to 10 mm, for example 3.0 mm.

The lenses and bezels of the invention may be treated with a surface coating to improve their utility in a specific application. For example, in the case of lenses for automotive headlamps, it is conventional to provide a surface coating of a UV absorber to extend the lifetime of otherwise UV-sensitive polycarbonate. Such UV-protective coatings may be made from acrylic or silicone-based polymers containing UV stabilizers, and are commonly applied by vapor deposition or chemical deposition. The coating is applied to at least the outer surface and edges, but may be applied to the entire exterior of the lens or bezel if desired. The lenses and bezels of the invention may also be used in other environments, for example to provide decorative effects in pool lighting, In this case, a chemically resistant coating would be used to protect the polycarbonate from degradation by pool chemicals. Alternatively, a chemically resistant polycarbonate formulation could be used.

Figure 2:
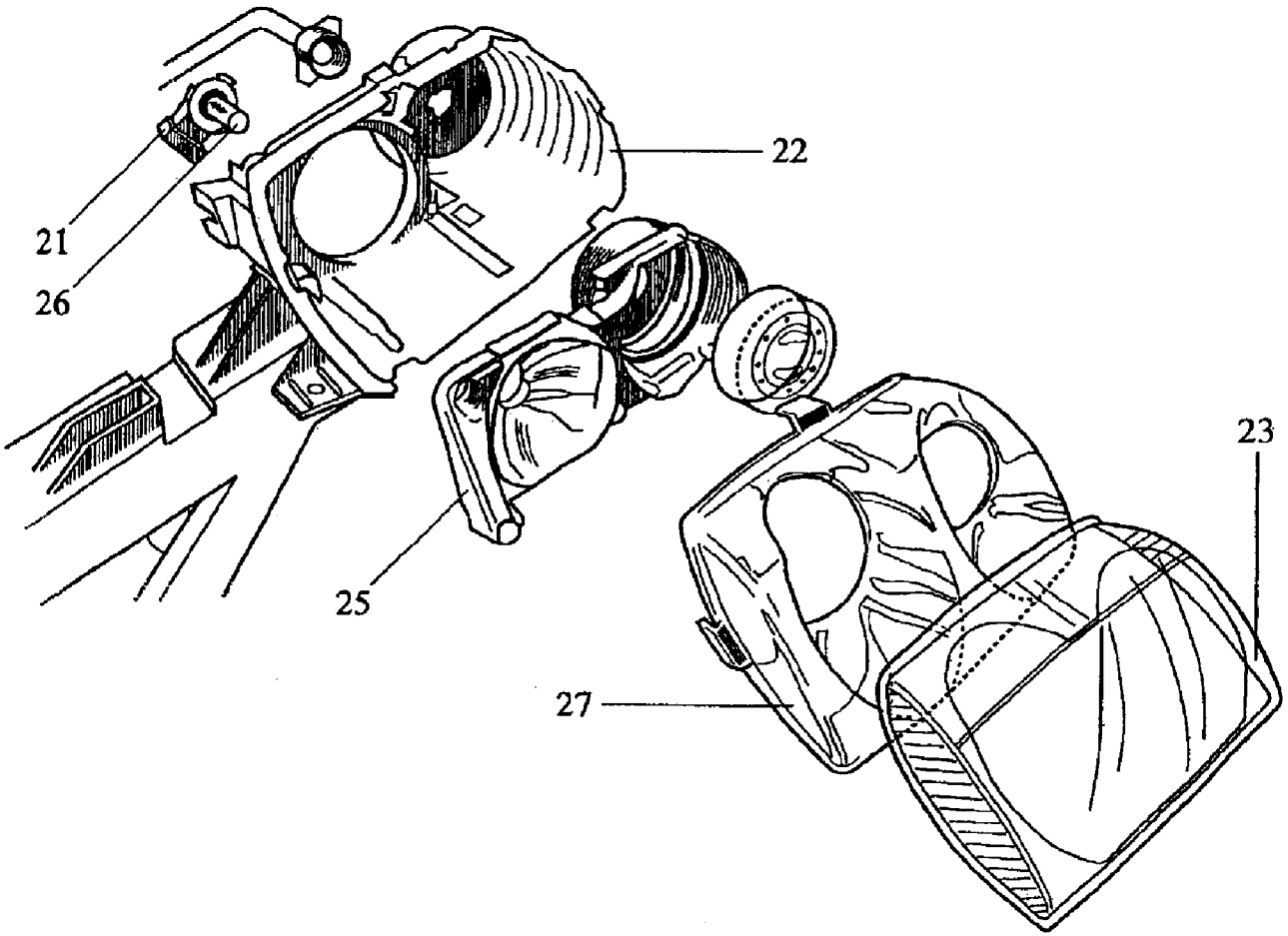
FIG. 2 shows an exploded view of an automotive headlamp in accordance with the invention.

FIG. 2 shows an exploded view of a headlamp in accordance with the invention. The headlamp has a housing 22 which contains reflector assembly 25, a light source 26 and an electrical connector 21 for attachment to the electrical system of a vehicle. A bezel 27 and a lens 23 are disposed on the exterior of the housing such that light leaving the housing passes through the bezel and the lens. Either or both of the bezel 27 and the lens 23 can be made from polycarbonate including an photoluminescent material in accordance with the invention. When both the bezel 27 and the lens 23 include an organic fluorescent dye, the dye may be the same or it may be different to provide a two-color effect. It will be appreciated that FIG. 2 shows one specific headlamp design and that numerous alternatives to the actual shape and structure exist. For example, the bezel may be omitted, and the housing and reflector may be a single component.

Polycarbonate formulations (A) to (G) described below have been defined to illustrate the ability to create a broad palette of visual effect color for outer lenses. A twin-screw extruder has been used for the compounding step with standard Lexan® LS-2 polycarbonate extrusion conditions. Color chips (5.08 cm×7.62 cm×3.2 mm) were molded for each formulation and color coordinates were measured on the chips in transmission mode using a MacBeth 7000A spectrophotometer selecting illuminant C and a 2 degree observer.

EXAMPLES

The invention will now be further described with reference to the following, non-limiting examples.

A polycarbonate resin composition (A) was prepared by mixing:

- 65 parts of poly(bisphenol-A carbonate) with an average molecular weight ($M_w$) of 29,900
- 35 parts of poly(bisphenol-A carbonate) with an average molecular weight ($M_w$) of 21,900
- 0.06 parts of tris(2,4-di-tert-butylphenyl) phosphite
- 0.27 parts of pentaerythritol tetrastearate
- 0.27 parts of 2-(2H-benzotriazol-2-yl)-4-(1,1,3,3-tetramethylbutyl)phenol
- 0.00015 parts of a yellow perylene derivative (BASF Lumogen Yellow F-083)
- 0.0001 parts of a red perylene derivative (BASF Lumogen Red F-300).

A polycarbonate resin composition (B) was prepared by mixing:

- 65 parts of poly(bisphenol-A carbonate) with an average molecular weight ($M_w$) of 29,900

35 parts of poly(bisphenol-A carbonate) with an average molecular weight ($M_w$) of 21,900–0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.00015 parts of a yellow perylene derivative (BASF Lumogen Yellow F-083)

0.000075 parts of C.I. Pigment Blue 60 (BASF Heliogen Blue K6330).

A polycarbonate resin composition (C) was prepared by mixing:

65 parts of poly(bisphenol-A carbonate) with an average molecular weight ($M_w$) of 29,900

35 parts of poly(bisphenol-A carbonate) with an average molecular weight ($M_w$) of 21,900

0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.01 parts of a naphtalimide derivative (BASF Lumogen Violet F-570)

0.0001 parts of C.I. Pigment Blue 60 (BASF Heliogen Blue K6330)

0.00005 parts of C.I. Solvent Violet 36 (Bayer Macrolex Violet 3R).

A polycarbonate resin composition (D) was prepared by mixing:

65 parts of poly(bisphenol-A carbonate) with an average molecular weight ($M_w$) of 29,900

35 parts of poly(bisphenol-A carbonate) with an average molecular weight ($M_w$) of 21,900

0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.05 parts of 2,5-bis(5'-tert-butyl-2-benzoxazolyl) thiophene (Ciba Uvitex OB)

0.0001 parts of C.I. Pigment Blue 60 (BASF Heliogen Blue K6330)

0.00005 parts of C.I. Solvent Violet 36 (Bayer Macrolex Violet 3R).

A polycarbonate resin composition (E) was prepared by mixing:

65 parts of poly(bisphenol-A carbonate) with an average molecular weight ($M_w$) of 29,900

35 parts of poly(bisphenol-A carbonate) with an average molecular weight ($M_w$) of 21,900–0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.00014 parts of a red perylene derivative (BASF Lumogen Yellow F-300).

A polycarbonate resin composition (F) was prepared by mixing:

65 parts of poly(bisphenol-A carbonate) with an average molecular weight ($M_w$) of 29,900

35 parts of poly(bisphenol-A carbonate) with an average molecular weight ($M_w$) of 21,900

0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.0002 parts of an orange perylene derivative (BASF Lumogen Orange F-240).

A polycarbonate resin composition (G) was prepared by mixing:

65 parts of poly(bisphenol-A carbonate) with an average molecular weight ($M_w$) of 29,900

35 parts of poly(bisphenol-A carbonate) with an average molecular weight ($M_w$) of 21,900

0.06 parts of tris(2,4-di-tert-butylphenyl) phosphite 0.27 parts of pentaerythritol tetrastearate 0.27 parts of 2-(2H-benzotriazol-2-yl)-4-(1,1,3,3-tetramethylbutyl)phenol 0.00026 parts of a yellow perylene derivative (BASF Lumogen Yellow F-083)

0.00014 parts of a red perylene derivative (BASF Lumogen Red F-300)

0.00003 parts of an orange perylene derivative (BASF Lumogen Orange F-240)

0.001 parts of 2,5-bis(5'-tert-butyl-2-benzoxazolyl) thiophene (Ciba Uvitex OB)

The color coordinates and the edge color are summarized in Table 1. This provides a clear illustration of the ability to create various visual effect colors with a total visible light transmission (Y) greater than about 87% at 3.2 mm thickness (average thickness of an outer lens).

Automotive outer lenses were molded from polycarbonate formulations (A) to (E). When the lenses were incorporated in automotive headlamps, it was apparent that the headlamp beam color was white while a strongly colored visual effect was observed that shines from accent features of the lens (ribs, lines and edges).

Lenses molded from formulations (A), (D) and (E) were also combined with a halogen bulb to test SAE conformity in a headlamp configuration. Natural color Lexan ® LS-2 resin was used as a reference in order to evaluate the lighting performance according to SAE J1383. The results of the isocandela testing (total flux), maximum candela (point intensity) and beam chromaticity (x,y) are summarized in Table 2. It is noteworthy that both the maximum candela and the isocandela confirm that the visual effect lenses combined to the halogen bulb give a comparable light output in terms of intensity which is within +/−5% of the reference (natural color). Moreover, headlamp with the blue lens made from formulation (D) displays a much bluer (i.e. whiter) beam compared to the reference as the CIE 1931 x chromaticity value is shifted from 0.4424 to 0.4040. This result is also confirmed by the visual evaluation of the beam color. Such combination is therefore a potential lower cost alternative to the use of HID bulbs in headlamps since it also provides a white light output that is usually perceived by the drivers as a lighting improvement.

Finally, it must be noted that all the outer lenses tested met the SAE requirements.

TABLE 1

| Formulation | Y | x | y | L* | a* | b* | Visual effect color |
|---|---|---|---|---|---|---|---|
| A | 87.77 | 0.3170 | 0.3253 | 95.06 | −1.04 | 4.58 | Orange |
| B | 88.75 | 0.3150 | 0.3257 | 95.48 | −2.23 | 4.40 | Green |
| C | 87.70 | 0.3087 | 0.3157 | 95.04 | −0.49 | −0.41 | Blue #1 |
| D | 87.85 | 0.3105 | 0.3202 | 95.10 | −1.82 | 1.60 | Blue #2 |
| E | 87.59 | 0.3121 | 0.3166 | 94.99 | 0.8 | 0.51 | Red/Pink |

TABLE 1-continued

| Formulation | Y | x | y | L* | a* | b* | Visual effect color |
|---|---|---|---|---|---|---|---|
| F | 88.17 | 0.3163 | 0.3166 | 95.24 | 2.97 | 1.25 | Yellow |
| G | 86.99 | 0.3207 | 0.3292 | 94.75 | −1.06 | 6.64 | Orange/Amber |

TABLE 2

| Lens | Max. | Total Flux | x | y | SAE conformity |
|---|---|---|---|---|---|
| "natural" LS-2 | 37979 | 754 | 0.442 | 0.407 | Pass |
| Formulation (A) | 36848 | 747 | 0.438 | 0.430 | Pass |
| Formulation (D) | 37410 | 746 | 0.404 | 0.403 | Pass |
| Formulation (E) | 36501 | 740 | 0.440 | 0.421 | Pass |

What is claimed is:

1. An automotive headlamp comprising, a housing for receiving a light source and an outer lens disposed such that light from a light source disposed in the housing passes through the lens, a reflector disposed within the housing wherein the reflector reflects light from a light source disposed within the housing toward the lens, wherein the lens comprises a polycarbonate and a photoluminescent material and provides a visual effect at least at an edge of the lens as a result of photoluminescense from the photoluminescent material, and wherein the housing, reflector, and lens work together with a light source disposed in the housing to provide an output beam from the headlamp.

2. The headlamp of claim 1, wherein the photoluminescent material is an organic fluorescent dye.

3. The headlamp of claim 2, wherein the fluorescent dye is included at a concentration of 1% or less by weight of the polycarbonate.

4. The headlamp of claim 3, wherein the fluorescent dye provides a blue or violet visual effect and the fluorescent dye is included at a concentration of 0.5 to 0.001% by weight.

5. The headlamp of claim 4, wherein the fluorescent dye is included at a concentration of 0.3 to 0.1% by weight.

6. The headlamp of claim 4, wherein the fluorescent dye is included at a concentration of 0.1% to 0.005% by weight.

7. The headlamp of claim 3, wherein the fluorescent dye provides a red, orange or green visual effect and the fluorescent dye is included at a concentration of less than 0.0005% by weight.

8. The headlamp of claim 7, wherein the fluorescent dye is included at a concentration of 0.0001% to 0.0003% by weight.

9. The headlamp of claim 2, wherein the fluorescent dye is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

10. The headlamp of claim 9, wherein the fluorescent dye is included at a concentration of 1% or less by weight of the polycarbonate.

11. The headlamp of claim 2, wherein the lens has one or more rib lines molded in the exterior surface thereof.

12. The headlamp of claim 11, wherein the fluorescent dye is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

13. The headlamp of claim 12, wherein the fluorescent dye is included at a concentration of 1% or less by weight of the polycarbonate.

14. The headlamp of claim 2, wherein the fluorescent dye has a quantum yield of 0.7 or greater.

15. The headlamp of claim 14, wherein the fluorescent dye has a quantum yield of 0.9 or greater.

16. The headlamp of claim 1, wherein the exterior surfaces of the lens are coated with a UV-protective coating.

17. The headlamp of claim 16, wherein the photoluminescent material is an organic fluorescent dye.

18. The headlamp of claim 17, wherein the fluorescent dye is included at a concentration of 1% or less by weight of the polycarbonate.

19. The headlamp of claim 18, wherein the fluorescent dye provides a blue or violet visual effect and the fluorescent dye is included at a concentration of 0.5 to 0.001% by weight.

20. The headlamp of claim 19, wherein the fluorescent dye is included at a concentration of 0.3 to 0.1% by weight.

21. The headlamp of claim 19, wherein the fluorescent dye is included at a concentration of 0.1 to 0.005% by weight.

22. The headlamp of claim 18, wherein the fluorescent dye provides a red, orange or green visual effect and the fluorescent dye is included at a concentration of less than 0.0005% by weight.

23. The headlamp of claim 22, wherein the fluorescent dye is included at a concentration of 0.0001% to 0.0003% by weight.

24. The headlamp of claim 17, wherein the fluorescent dye is selected from the group consisting of perylenes, anthracenes, indigoids and thioindigoids, imidazole, naphtalimides, xanthenes, thioxanthenes, coumarins, rhodamines, (2,5-bis[5-tert-butyl-2-benzoxazolyl] thiophene).

25. The headlamp of claim 24, wherein the fluorescent dye is included at a concentration of 1% or less by weight of the polycarbonate.

26. The headlamp of claim 17, wherein the lens has one or more rib lines molded in the exterior surface thereof.

27. The headlamp of claim 26, wherein the fluorescent dye is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

28. The headlamp of claim 26, wherein the fluorescent dye is included at a concentration of 1% or less by weight of the polycarbonate.

29. The headlamp of claim 17, wherein the fluorescent dye has a quantum yield of 0.7 or greater.

30. The headlamp of claim 29, wherein the fluorescent dye has a quantum yield of 0.9 or greater.

31. The headlamp of claim 1, further comprising a bezel disposed between the lens and the housing.

32. The headlamp of claim 31, wherein the bezel comprises a polycarbonate and an photoluminescent material which may be the same as or different from the photoluminescent dye in the lens.

33. The headlamp of claim 32, wherein the photoluminescent dye in the bezel produces a visual effect of a different color from the photoluminescent dye in the lens.

34. The headlamp of claim 33, wherein the photoluminescent material included in the bezel is an organic fluorescent dye.

35. The headlamp of claim 34, wherein the fluorescent dye included in the bezel is included at a concentration of 1% or less by weight of the polycarbonate.

36. The headlamp of claim 35, wherein the fluorescent dye in the bezel provides a blue or violet visual effect and the fluorescent dye is included at a concentration of 0.5 to 0.001% by weight.

37. The headlamp of claim 36, wherein the fluorescent dye in the bezel is included at a concentration of 0.3 to 0.1% by weight.

38. The headlamp of claim 36, wherein the fluorescent dye in the bezel is included at a concentration of 0.1 to 0.005% by weight.

39. The headlamp of claim 35, wherein the fluorescent dye in the bezel provides a red, orange or green visual effect and the fluorescent dye is included at a concentration of less than 0.0005% by weight.

40. The headlamp of claim 39, wherein the fluorescent dye in the bezel is included at a concentration of 0.0001% to 0.0003% by weight.

41. The headlamp of claim 34, wherein the fluorescent dye in the bezel is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl]thiophene).

42. The headlamp of claim 41, wherein the fluorescent dye in the bezel is included at a concentration of 1% or less by weight of the polycarbonate.

43. The headlamp of claim 1, wherein the light source and the material of the lens are selected such that light emitted from the light source is modified in chromaticity as it passes through the lens such that the illuminating beam from the headlamp has an average x chromaticity coordinate of between 0.31 to 0.50.

44. An automotive headlamp comprising, a housing for receiving a light source, a bezel and an outer lens disposed such that light from a light source disposed in the housing passes through the bezel and the lens, a reflector disposed within the housing wherein the reflector reflects light from a light source disposed within the housing toward the lens, wherein the bezel comprises a polycarbonate and an photoluminescent material and wherein the bezel provides a visual effect at least at an edge of the bezel as a result of photoluminescense from the photoluminescent material, and wherein the housing, reflector, bezel and lens work together with a light source disposed within the housing to provide an output beam from the headlamp.

45. The headlamp of claim 44, wherein the photoluminescent material is an organic fluorescent dye.

46. The headlamp of claim 45, wherein the fluorescent dye is included at a concentration of 1% or less by weight of the polycarbonate.

47. The headlamp of claim 46, wherein the fluorescent dye provides a blue or violet visual effect and the fluorescent dye is included at a concentration of 0.5 to 0.001% by weight.

48. The headlamp of claim 47, wherein the fluorescent dye is included at a concentration of 0.3 to 0.1% by weight.

49. The headlamp of claim 47, wherein the fluorescent dye is included at a concentration of 0.1 to 0.005% by weight.

50. The headlamp of claim 46, wherein the fluorescent dye provides a red, orange or green visual effect and the fluorescent dye is included at a concentration of less than 0.0005% by weight.

51. The headlamp of claim 50, wherein the fluorescent dye is included at a concentration of 0.0001% to 0.0003% by weight.

52. The headlamp of claim 45, wherein the fluorescent dye is selected from the group consisting of perylene, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

53. The headlamp of claim 52, wherein the fluorescent dye is included at a concentration of 1% or less by weight of the polycarbonate.

54. The headlamp of claim 45, wherein the fluorescent dye has a quantum yield of 0.7 or greater.

55. The headlamp of claim 54, wherein the fluorescent dye has a quantum yield of 0.9 or greater.

56. The headlamp of claim 44, wherein the photoluminescent material is an organic nano-particle.

57. The headlamp of claim 56, wherein the organic nano-particle comprises a fluorescent dye selected from the group consisting of perylenes, anthracenes, indigoids and thioindigoids, imidazoles, naphtalimides, xanthenes, thioxanthenes, coumarins, rhodamines, or (2,5-bis[5-tert-butyl-2-benzoxazolyl]-thiophene).

58. The headlamp of claim 44, wherein the photoluminescent material is an inorganic nano-particle.

59. The headlamp of claim 44, wherein the light source and the material of the bezel and lens are selected such that light emitted from the light source is modified in chromaticity as it passes through the tens such that the illuminating beam from the headlamp has an average x chromaticity coordinate of between 0.31 to 0.50.

60. A lens comprising a molded body having a generally concave outer surface, a generally flat or convex inner surface and an edge surface, wherein the molded body is formed from a composition comprising polycarbonate and an photoluminescent material, wherein white light transmitted through the lens from the inner surface to the outer surface forms an output beam, and wherein the transmission of white light through the lens results in emission from the fluorescent dye which is conducted to a substantial extent to the edge surface of the lens thereby creating a colored visual effect at the edge of the lens.

61. The lens of claim 60, wherein the photoluminescent material is an organic fluorescent dye.

62. The lens of claim 61, wherein the fluorescent dye is included at a concentration of 1% or less by weight of the polycarbonate.

63. The lens of claim 61, wherein the fluorescent dye is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

64. The lens of claim 63, wherein the fluorescent dye is included at a concentration of 1% or less by weight of the polycarbonate.

65. The lens of claim 63, wherein the fluorescent dye in the bezel provides a blue or violet visual effect and the fluorescent dye is included at a concentration of 0.5 to 0.001% by weight.

66. The lens of claim 65, wherein the fluorescent dye in the bezel is included at a concentration of 0.3 to 0.1% by weight.

67. The lens of claim 65, wherein the fluorescent dye in the bezel is included at a concentration of 0.1 to 0.005% by weight.

68. The lens of claim 61, wherein the fluorescent dye in the bezel provides a red, orange or green visual effect and the fluorescent dye is included at a concentration of less than 0.0005% by weight.

69. The lens of claim 68, wherein the fluorescent dye in the bezel is included at a concentration of 0.0001% to 0.0003% by weight.

70. The lens of claim 61, wherein the lens has one or more rib lines molded in the exterior surface thereof.

71. The lens of claim 70, wherein the fluorescent dye is selected from the group consisting of perylenes, indigoids and thioindigoids, imidazoles, naphtalimide, xanthenes, thioxanthenes, coumarins, rhodamines, (2,5-bis[5-tert-butyl-2-benzoxazolyl]thiophene).

72. The lens of claim 70, wherein the fluorescent dye is included at a concentration of 1% or less by weight of the polycarbonate.

73. The lens of claim 61, wherein the lens has an UV-protective coating on the outer surface and the edge surface.

74. The lens of claim 61, wherein the lens has an UV-protective coating on the inner and outer surfaces and the edge surface.

75. The lens of claim 60, wherein the photoluminescent material is an organic nanoparticle.

76. The lens of claim 75, wherein the organic nanoparticle comprises a fluorescent dye selected from the group consisting of perylenes, anthracenes, indigoids and thioindigoids, imidazoles, naphtalimide, xanthenes, thioxanthenes, coumarins, rhodamines, or (2,5-bis[5-tert-butyl-2-benzoxazolyl]-thiophene).

77. The headlamp of claim 60, wherein the photoluminescent material is an inorganic nano-particle.

78. A bezel comprising an annular molded body having a generally concave outer surface, a generally flat or convex inner surface and inner and outer edge surfaces, wherein the molded body is formed from a composition comprising polycarbonate and an photoluminescent material, and wherein white light transmitted through the bezel results in emission from the fluorescent dye which is conducted to a substantial extent to the edge surfaces of the bezel thereby creating a colored visual effect at the edges of the bezel.

79. The bezel of claim 78, wherein the photoluminescent material is an organic fluorescent dye.

80. The bezel of claim 79, wherein the fluorescent dye is included at a concentration of 1% or less by weight of the polycarbonate.

81. The bezel of claim 78, wherein the fluorescent dye is selected from the group consisting of perylenes, anthracenes, indigoids and thioindigoids, imidazoles, naphtalimides, xanthenes, thioxanthenes, coumarins, rhodamines, (2,5-bis[5-tert-butyl-2-benzoxazolyl] thiophene).

82. The bezel of claim 81, wherein the fluorescent dye is included at a concentration of 1% or less by weight of the polycarbonate.

83. The bezel of claim 79, wherein the fluorescent dye in the bezel provides a blue or violet visual effect and the fluorescent dye is included at a concentration of 0.5 to 0.001% by weight.

84. The bezel of claim 83, wherein the fluorescent dye in the bezel is included at a concentration of 0.3 to 0.1% by weight.

85. The bezel of claim 83, wherein the fluorescent dye in the bezel is included at a concentration of 0.1 to 0.005% by weight.

86. The bezel of claim 79, wherein the fluorescent dye in the bezel provides a red, orange or green visual effect and the fluorescent dye is included at a concentration of less than 0.0005% by weight.

87. The bezel of claim 86, wherein the fluorescent dye in the bezel is included at a concentration of 0.0001% to 0.0003% by weight.

88. The bezel of claim 79, wherein the bezel has one or more rib lines molded in the exterior surface thereof.

89. The bezel of claim 88, wherein the fluorescent dye is selected from the group consisting of perylenes, anthracenes, indigoids and thioindigoids, imidazole, naphtalimide, xanthenes, thioxanthenes, coumarins, rhodamines, (2,5-bis[5-tert-butyl-2-benzoxazolyl] thiophene).

90. The bezel of claim 89, wherein the fluorescent dye is included at a concentration of 1% or less by weight of the polycarbonate.

91. The bezel of claim 79, wherein the bezel is compliant with SAE standards for automotive headlamps.

92. The bezel of claim 79, wherein the bezel has an UV-protective coating on the outer surface and the edge surfaces.

93. The bezel of claim 79, wherein the bezel has an UV-protective coating on the inner and outer surfaces and the edge surfaces.

94. The bezel of claim 78, wherein the photoluminescent material is an organic nanoparticle.

95. The bezel of claim 94, wherein the organic nanoparticle comprises a fluorescent dye selected from the group consisting of perylene, anthracene, indigoids and thioindigoids, imidazole, naphtalimide, xanthenes, thioxanthenes, coumarins, rhodamines, or (2,5-bis[5-tert-butyl-2-benzoxazolyl]-thiophene).

96. The bezel of claim 78, wherein the photoluminescent material is an inorganic nano-particle.

97. A method for making or bezel having a luminescent visual effect for an automotive headlamp, comprising the steps of preparing a molding composition comprising a polycarbonate and a photoluminescent material, molding the lens or bezel from the molding composition, and optionally forming cuts or protrusions, or both, in a surface of the lens or bezel article to define the graphic image, wherein the step of forming the cuts or protrusions can occur during or subsequent to the molding step, and wherein the luminescent visual effect occurs at least at an edge of the lens or bezel and at cuts and protrusions formed therein.

98. The method of claim 97, wherein the photoluminescent material is an organic fluorescent dye.

99. The method of claim 97, wherein the photoluminescent material is an organic nano-particle comprising an organic fluorescent dye.

100. The method of claim 97, wherein the photoluminescent material is an inorganic nano-particle.

* * * * *

UNITED STATES PATENT AND TRADEMARK OFFICE

CERTIFICATE OF CORRECTION

PATENT NO. : 6,893,147 B2
APPLICATION NO. : 10/063791
DATED : May 17, 2005
INVENTOR(S) : Schottland et al.

It is certified that error appears in the above-identified patent and that said Letters Patent is hereby corrected as shown below:

Column 12,
Line 31, “imidazole” should read -- imidazoles --.

Column 13,
Line 67, “perylene” should read -- perylenes --.

Column 15,
Line 3, “naphtalimide” should read -- naphtalimides --.
Line 19, “naphtalimide” should read -- naphtalimides --.
Line 22, “headlamp” should read -- lens --.
Line 37, “claim 78” should read -- claim 79 --.

Column 16,
Line 12, “imidazole” should read -- Imidazoles --.
Line 13, “naphtalimide” should read -- naphtalimides --.
Line 31, “perylene, anthracene” should read -- perylenes, anthracenes --.
Line 32, “imidazole, naphtalimide” should read -- imidazoles, naphtalimides --.

Signed and Sealed this

Twentieth Day of June, 2006

JON W. DUDAS
*Director of the United States Patent and Trademark Office*